US007934280B2

(12) United States Patent
Kim et al.

(10) Patent No.: US 7,934,280 B2
(45) Date of Patent: May 3, 2011

(54) DRUM-TYPE WASHING MACHINE AND TUB CLEANING METHOD OF THE SAME

(75) Inventors: Jong Min Kim, Changwon-si (KR); Du Heig Choi, Changwon-si (KR); Min Su Kang, Changwon-si (KR); Yoon Sang Lee, Seoul (KR); Han Ki Cho, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 265 days.

(21) Appl. No.: 12/093,010

(22) PCT Filed: Oct. 13, 2006

(86) PCT No.: PCT/KR2006/004134

§ 371 (c)(1),
(2), (4) Date: Oct. 9, 2008

(87) PCT Pub. No.: WO2007/055475

PCT Pub. Date: May 18, 2007

(65) Prior Publication Data

US 2009/0090388 A1 Apr. 9, 2009

(30) Foreign Application Priority Data

Nov. 11, 2005 (KR) ..... 10-2005-0107967
Dec. 2, 2005 (KR) ..... 10-2005-0117187
Dec. 2, 2005 (KR) ..... 10-2005-0117188

(51) Int. Cl.
*D06F 33/02* (2006.01)

(52) U.S. Cl. ..... 8/158; 68/12.01

(58) Field of Classification Search ..... 68/12.02, 68/207
See application file for complete search history.

(56) References Cited

U.S. PATENT DOCUMENTS 3,770,376 A * 11/1973 Sharpe ..... 8/158
6,463,766 B2 * 10/2002 Kubota et al. ..... 68/12.18
7,585,374 B2 * 9/2009 Sechelmann ..... 134/18
2006/0151005 A1 * 7/2006 Kim et al. ..... 134/22.1

FOREIGN PATENT DOCUMENTS

DE 197 42 282 2/1999
DE 197 51 028 5/1999
JP 02-104397 * 4/1990
JP 02-161997 * 6/1990
JP 10-328473 * 12/1998

(Continued)

OTHER PUBLICATIONS

European Patent Office 1 365 057 Nov. 2003.* Korean Office Action dated May 2, 2007.
International Search Report dated Jan. 30, 2007.

(Continued)

*Primary Examiner* — Frankie L Stinson
(74) *Attorney, Agent, or Firm* — Ked & Associates LLP

(57) ABSTRACT

A drum-type washing machine, and tub and gasket cleaning methods are provided. The drum-type washing machine may include a tub mounted in a cabinet such that a wash water is supplied into the tub, a drum rotatably mounted in the tub such that laundry may be put into the drum, a motor that rotates the drum, and a controller that controls a driving of the motor such that, when the drum is rotated, the wash water supplied into the tub reaches an upper part of an inner circumferential surface of the tub so as to clean the inner circumferential surface of the tub and the gasket.

18 Claims, 3 Drawing Sheets

FOREIGN PATENT DOCUMENTS

| | | | |
|---|---|---|---|
| JP | 2004-081508 | * | 3/2004 |
| KR | 10-2004-0045115 | | 6/2004 |
| KR | 10-2004-0081590 | | 9/2004 |
| KR | 10-2005-0041896 | | 5/2005 |

OTHER PUBLICATIONS

Korean Office Action dated Nov. 9, 2008.
Korean Office Action dated Nov. 14, 2008.

* cited by examiner

[Fig. 1]
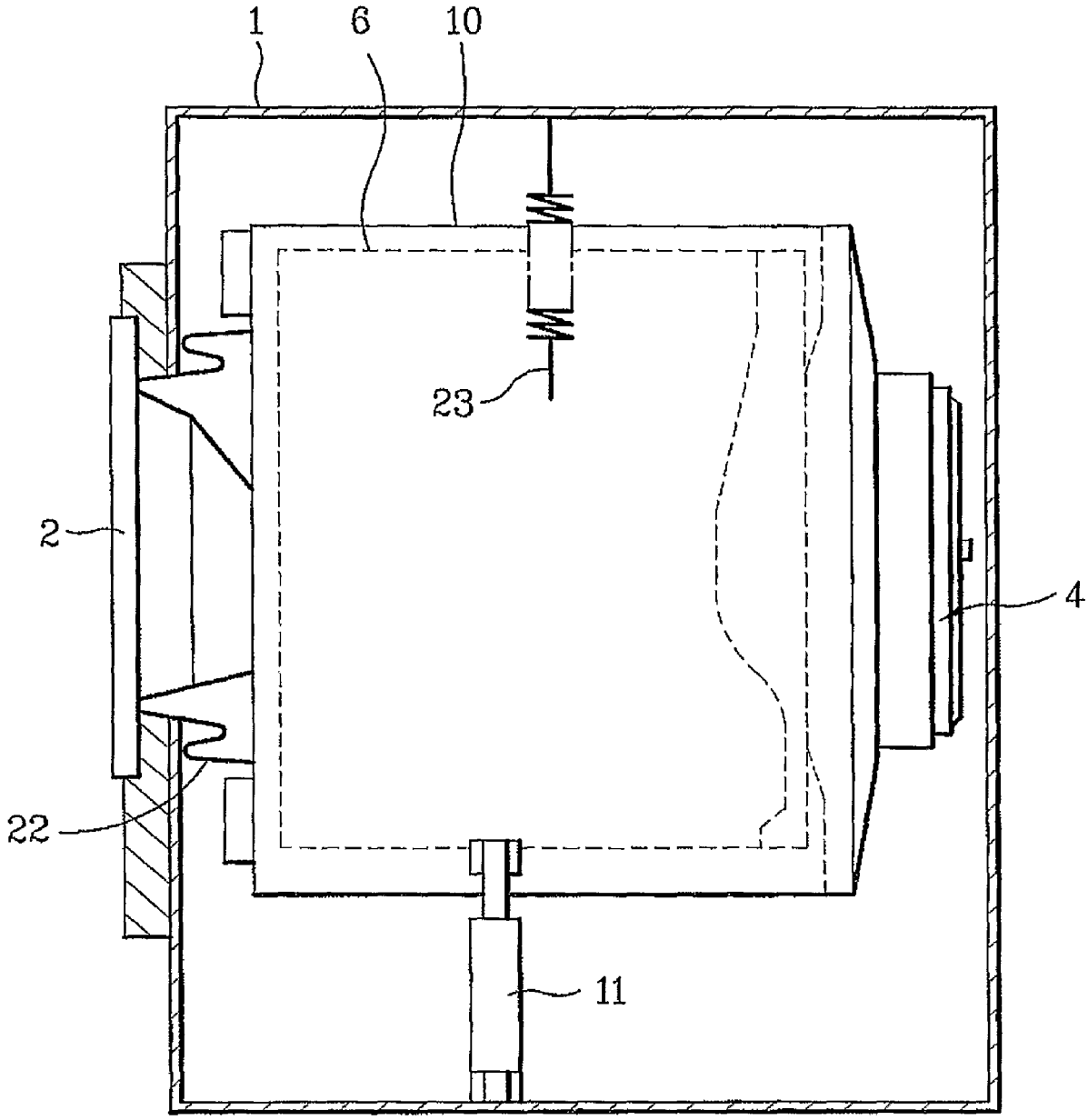

[Fig. 2]
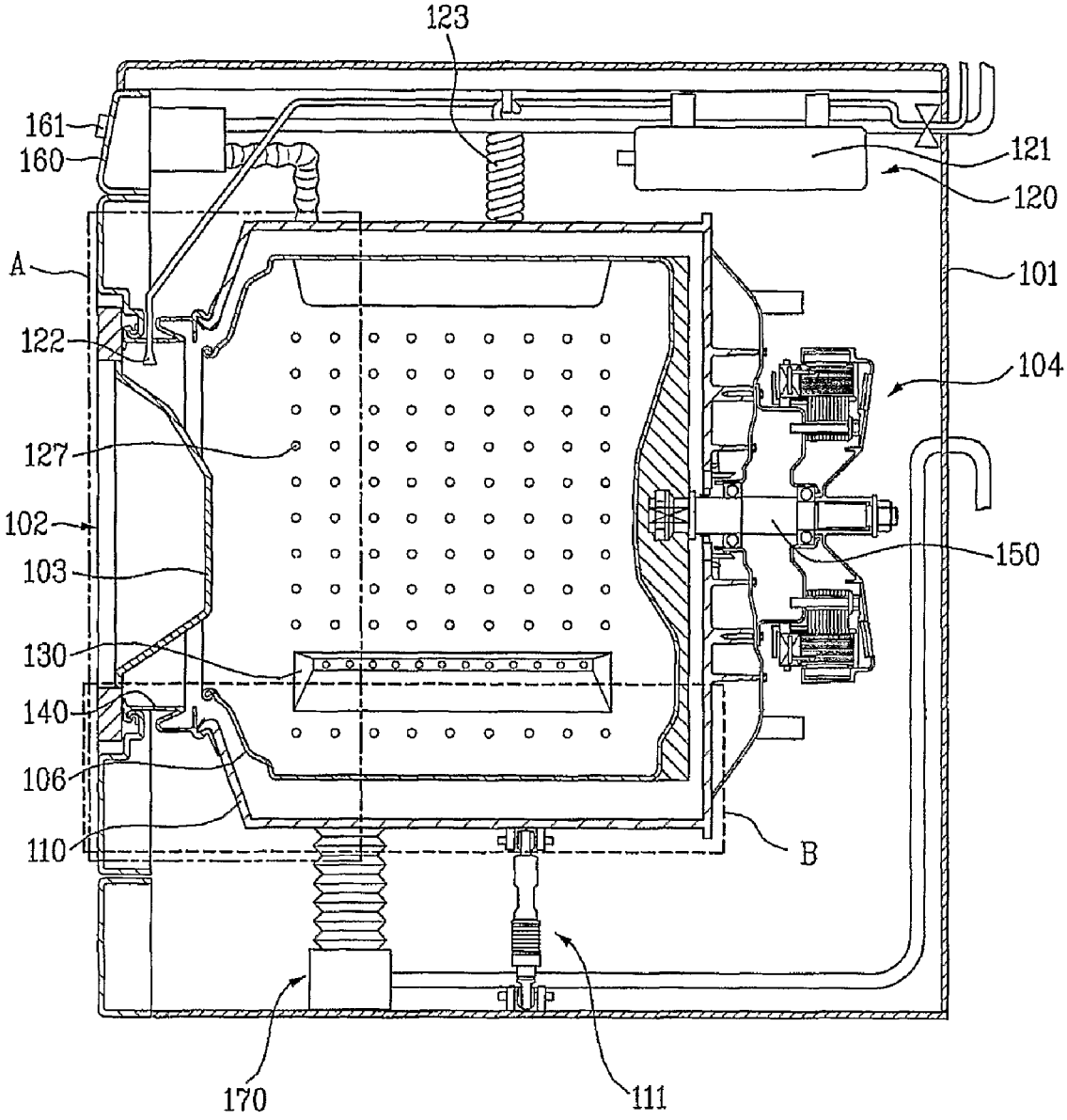

[Fig. 3]
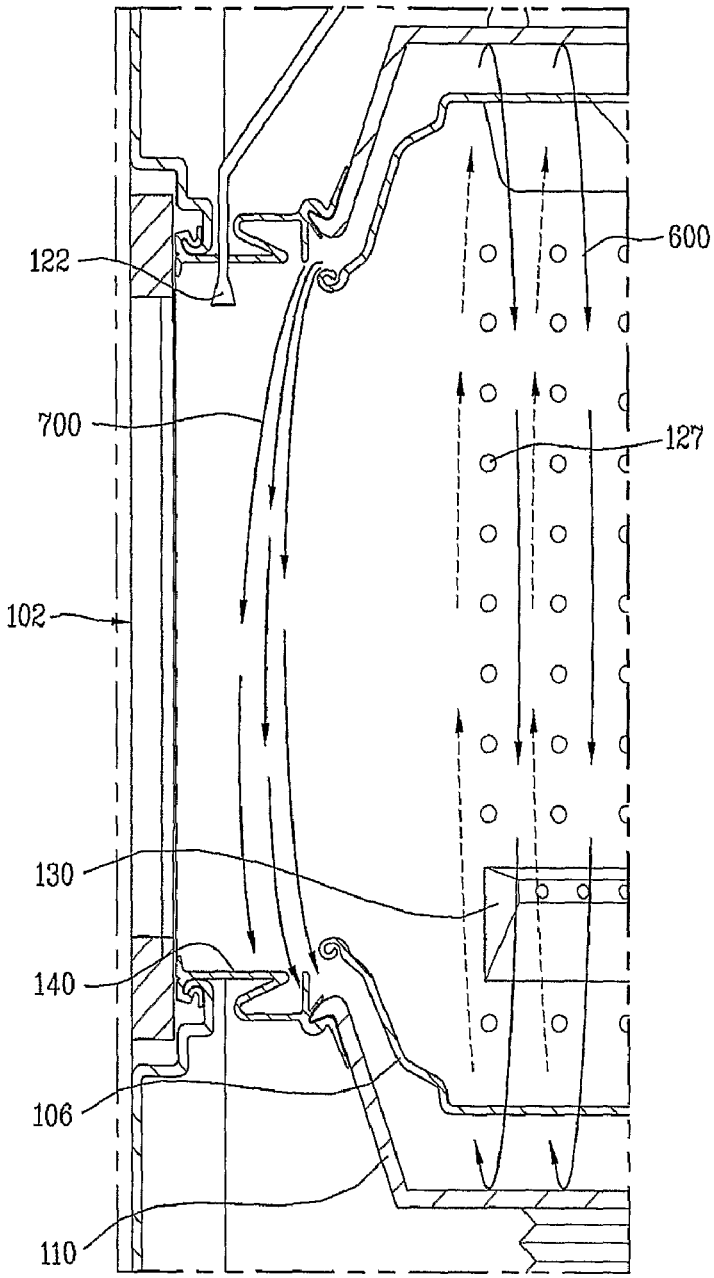
[Fig. 4]
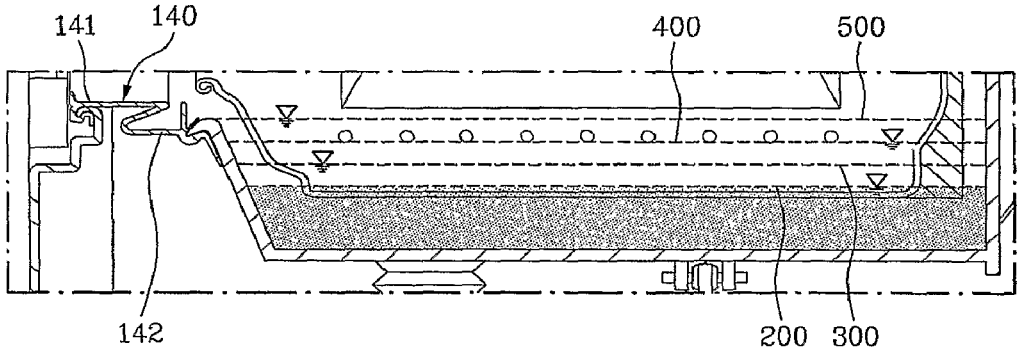

DRUM-TYPE WASHING MACHINE AND TUB CLEANING METHOD OF THE SAME

TECHNICAL FIELD

The present invention relates to a washing machine, and more particularly, to a drum-type washing machine that is capable of easily cleaning a tub and a tub cleaning method of the same. In addition, the present invention relates to a drum-type washing machine that is capable of cleaning a gasket along with cleaning of the tub and a gasket cleaning method of the same.

BACKGROUND ART

Generally, a drum-type washing machine is a kind of washing machine that performs a washing operation using the friction between a drum, which is rotated by a driving force of a motor, and laundry put in the drum and using impact applied to the laundry when the laundry drops, under the condition that detergent and wash water are also put in the drum. The drum-type washing machine has various effects in that damage to the laundry is minimized, the laundry is not entangled, and the laundry is struck and rubbed.

In a pulsator-type washing machine, which is another kind of washing machine, on the other hand, a spin-drying tub is mounted in a water storage tub, in which water is stored, and a washing operation is performed under the condition that laundry is submerged in wash water supplied into the spin-drying tub. As a result, the pulsator-type washing machine uses a large amount of wash water.

The pulsator-type washing machine performs a washing operation using the friction between the wash water and the laundry caused by the rotation of the spin-drying tub or a pulsator mounted below the spin-drying tub for generating a water current and using the action of detergent.

Specifically, in the drum-type washing machine, the rotation axis of the drum is substantially parallel with the ground, and therefore, the laundry can be dropped and washed even when a small amount of wash water is stored in a tub and the drum. In the pulsator-type washing machine, on the other hand, the rotation axis of the spin-drying tub is substantially perpendicular to the ground, and therefore, the laundry can be washed only after the wash water is supplied to the water storage tub such that the laundry is fully submerged in the wash water.

In the conventional pulsator-type washing machine, even the upper part of the water storage tub is submerged in the wash water as described above. Such submergence is repeated whenever the washing machine is operated. Since the water storage tub is not driven, pollutants or scale may be accumulated on the entire inner circumferential surface of the water storage tub as well as the lover part of the water storage tub. With the passage of time, the pollutants or the scale may decompose with the result that the pollutants or the scale may give off a bad smell or the laundry may be polluted by the pollutants or the scale.

For this reason, there have been proposed various methods of cleaning the inner circumferential surface of the water storage tub of the conventional pulsator-type washing machine. Nevertheless, it is not easy to clean the water storage tub using a strong water current obtained by rotating the spin-drying tub at high speed while the wash water is stored in the water storage tub.

This is because, when the spin-drying tub is rotated at high speed, excessive load is applied to a motor due to the friction between the wash water and the outer circumferential surface of the spin-drying tub. Even if the spin-drying tub is rotated at very high speed, it is difficult for the wash water to reach the upper side part of the inner circumferential surface of the water storage tub.

In the conventional pulsator-type washing machine, therefore, the water storage tub is cleaned using special detergent during a general washing or rinsing operation.

For this reason, the detergent used to clean the water storage tub has a stronger cleaning force than detergent used to perform the general washing operation. Specifically, the detergent used to clean the water storage tub contains a large amount of chemical components causing water pollution, and therefore, the detergent used to clean the water storage tub is not environmentally friendly.

FIG. 1 is a view schematically illustrating the construction of a conventional drum-type washing machine. Hereinafter, the construction of the conventional drum-type washing machine will be described in brief with reference to FIG. 1.

As show in FIG. 1, the drum-type washing machine includes a cabinet 1 having a laundry inlet hole formed in the front part thereof, a door 2 mounted at the cabinet 1 for opening and closing the laundry inlet hole, a tub 10 mounted in the cabinet 1 for storing wash water, a motor 4 mounted to the tub 10 for generating a driving force, a washing shaft 5 connected to the motor 4, and a drum 6 connected to the washing shaft 5 for washing laundry using the driving force transmitted from the motor 4.

The tub 10 is supported by a damper 11 and a spring 23. The damper 11 and the spring 23 serve to absorb vibration generated when the motor 4 and the drum 6 are rotated.

The motor 4 includes a rotor (not shown) and a stator (not shown).

In the drum-type washing machine with the above-stated construction, wash water is supplied such that the lower part of the tub 10 and the lower part of the drum 6 are submerged in the wash water, unlike the previously described pulsator-type washing machine. And only some of the wash water stored in the lower part of the tub 10 is raised together with the laundry by lifters (not shown) mounted inside the drum and then drops.

According to the washing manner of the drum-type washing machine, therefore, opposite side parts of the inner circumferential surface of the tub and the upper side part of the inner circumferential surface of the tub are not submerged in the wash water, unlike the pulsator-type washing machine.

In the conventional drum-type washing machine, therefore, the probability that pollutants or scale may be accumulated at the opposite side parts of the inner circumferential surface of the tub, particularly, the upper side part of the inner circumferential surface of the tub is not considered. As a result, the necessity for cleaning the pollutants or the scale accumulated at the opposite side parts of the inner circumferential surface of the tub, particularly, the upper side part of the inner circumferential surface of the tub, has not come to the front.

Meanwhile, even though the term "the cleaning of the tub" is used in the conventional drum-type washing machine, this term does not mean the cleaning of the opposite side parts of the inner circumferential surface of the tub, particularly, the upper side part of the inner circumferential surface of the tub. In other words, this term means only the cleaning of the lower side part of the inner circumferential surface of the tub.

However, the inventor of the present invention has found that the pollutants and the scale may be accumulated at the opposite side parts of the inner circumferential surface of the tub and the upper side part of the inner circumferential surface of the tub as well as the lower side part of the inner circumferential surface of the tub, and therefore, the accumulated pollutants or the accumulated scale gives off a bad smell, and furthermore, laundry is polluted by the pollutants or the scale.

Consequently, a method of easily cleaning the entire inner circumferential surface of the tub without using an additional cleaning device for cleaning the tub has been studied.

In addition, the conventional drum-type washing machine is essentially provided with a gasket mounted between the door and the tub for preventing the leakage of the wash water. However, there is much possibility that pollutants are accumulated at the lower part of the gasket due to the sectional shape of the gasket. And these pollutants are not easily visible unless a user deforms the gasket to turn the gasket inside out. Consequently, it is not easy to remove the pollutants from the gasket.

For this reason, a method of easily cleaning the gasket without using an additional cleaning device for cleaning the gasket has been also studied.

DISCLOSURE OF INVENTION

Technical Problem

An object of the present invention devised to solve the problem lies on a drum-type washing machine constructed in a structure in which wash water circulates along the inner side surface of a tub to easily clean the tub and a tub cleaning method of the same.

Another object of the present invention devised to solve the problem lies on a drum-type washing machine constructed in a structure in which some of wash water drops to clean a gasket and a gasket cleaning method of the same.

Technical Solution

The object of the present invention can be achieved by providing a drum-type washing machine comprising: a tub mounted in a cabinet such that wash water is supplied into the tub; a drum rotatably mounted in the tub such that laundry is put into the drum; a motor for rotating the drum; and a control unit for controlling the driving of the motor such that, when the drum is rotated, the wash water supplied into the tub reaches the upper part of the inner circumferential surface of the tub so as to clean the inner circumferential surface of the tub.

Preferably, the control unit controls the rotation speed of the drum such that the wash water supplied into the tub circulates along the inner circumferential surface of the tub. The drum-type washing machine may further comprise an input unit for allowing a user to input a command for cleaning the inner circumferential surface of the tub.

Preferably, the control unit controls the rotation speed of the drum to be higher than predetermined rotation speeds of the drum for a washing or rinsing operation and lower than a predetermined rotation speeds of the drum for a spin-drying operation. Also preferably, the control unit controls the water level of the wash water supplied into the tub such that the wash water circulates along the inner circumferential surface of the tub.

More preferably, the control unit controls the drum to be rotated at a rotation speed of the drum approximately 4 or 5 times higher than the predetermined rotation speed of the drum for the washing operation. Also preferably, the control unit controls the rotation speed of the drum such that the lower the water level of the wash water supplied into the tub is, the higher the rotation speed of the drum is. Specifically, it is preferable to control the rotation speed of the drum and the water level of the wash water such that the wash water can circulate at least along the inner circumferential surface of the tub.

Preferably, the control unit controls the water level of the wash water such that the water level of the wash water is higher than the minimum water level at which some of the wash water also circulates in the drum and lower than the full water level.

This is to prevent overload from being applied to the motor. Furthermore, this is for a user to watch the circulation of the wash water in the drum and thus to confirm that the tub cleaning is being carried out. More preferably, therefore, the control unit controls the water level of the wash water supplied into the drum to be higher than the predetermined water level of the wash water for the rinsing operation.

Also preferably, the control unit controls the water level of the wash water supplied into the tub and the rotation speed of the drum such that some of the wash water circulating in the drum is introduced to the lower part of a gasket so as to clean the gasket. This is to also clean pollutants or scale accumulated at the lower part of the gasket.

In addition, the control unit may control the rotation speed of the drum and the water level of the wash water stored in the tub such that the pollutants or the scale is removed from the gasket by some of the wash water dropping without circulating along the inner circumferential surface of the tub.

The drum-type washing machine may further comprise a steam supply unit for supplying high-temperature and high-pressure steam into the tub and the drum.

In another aspect of the present invention, provided herein is a tub cleaning method of a drum-type washing machine, comprising: introducing wash water into a tub and storing the wash water in the tub; and cleaning the inner circumferential surface of a tub using the wash water reaching the upper part of the inner circumferential surface of the tub as a drum is rotated at a predetermined rotation speed by the driving of a motor, which is controlled by a control unit.

Preferably, at the step of cleaning the inner circumferential surface of the tub, the wash water circulates along the inner circumferential surface of the tub. And preferably, the step of storing the wash water in the tub is carried out after a step of allowing a user to input a command for cleaning the inner circumference surface of the tub.

Also preferably, the tub cleaning method further comprises supplying steam into the tub or the drum such that the inner temperature and the inner humidity of the tub and the drum are increased, and therefore, pollutants accumulated at the inner circumferential surface of the tub are soaked, before, after, or simultaneously with the step of storing the wash water in the tub.

The tub cleaning method may further comprise repeatedly draining the wash water and cleaning the inner circumferential surface of the tub such that the pollutants removed from the tub cannot remain in the tub or the drum after the step of cleaning the inner circumferential surface of the tub. Preferably, at the step of cleaning the inner circumferential surface of the tub, the drum is repeatedly rotated in the forward direction and in the reverse direction.

In a further aspect of the present invention, provided herein is a gasket cleaning method of a drum-type washing machine, comprising: introducing wash water into a tub and storing the wash water in the tub; and cleaning a gasket using the wash water reaching the upper part of the inner circumferential surface of the tub and then dropping as a drum is rotated at a predetermined rotation speed by the driving of a motor, which is controlled by a control unit.

BRIEF DESCRIPTION OF THE DRAWINGS

The accompanying drawings, which are included to provide a further understanding of the invention, illustrate embodiments of the invention and together with the description serve to explain the principle of the invention.

In the drawings:

FIG. 1 is a view schematically illustrating the construction of a conventional drum-type washing machine.

FIG. 2 is a sectional view schematically illustrating the construction of a drum-type washing machine according to the present invention.

FIG. 3 is an enlarged view illustrating an A part of FIG. 2.

FIG. 4 is an enlarged view illustrating a B part of FIG. 2.

BEST MODE FOR CARRYING OUT THE INVENTION

Reference will now be made in detail to the preferred embodiments of the present invention, examples of which are illustrated in the accompanying drawings.

Hereinafter, the construction of a drum-type washing machine according to the present invention will be described in detail with reference to FIG. 2, which is a sectional view schematically illustrating the construction of a drum-type washing machine according to the present invention. A detailed description of components of the drum-type washing machine according to the present invention corresponding to those of the previously described conventional drum-type washing machine will not be given.

In the specification, water for washing and water for tub cleaning are also referred to as wash water. Since the present invention is directed to tub cleaning or gasket cleaning, however, the water for washing is out of the question.

As shown in FIG. 2, the drum-type washing machine according to the present invention includes a tub 110, a drum 106, a motor 104 for rotating the drum 106, and a control unit 160 for control the rotation speed of the motor 104 and the water level of wash water supplied into the tub 110 such that the wash water supplied into the tub 110 reaches the upper part of the inner circumferential surface of the tub 110 so as to clean the inner circumferential surface of the tub 110.

FIG. 2 illustrates a direct connection type driving structure in which the motor 104 is directly connected to a washing shaft 150 so as to the drive the drum 106. However, the present invention is not limited to the direct connection type driving structure. In addition, the control unit 160 is illustrated to be mounted at a control panel disposed at the front part of a cabinet 101. However, the present invention is not limited to the illustrated structure.

The tub 110 is mounted in the cabinet 101, while being supported by a spring 123 and a friction damper 111, such that wash water is supplied into the tub 110. That is to say, the tub is not driven.

The drum 106 is mounted in the tub 110 such that the drum 106 can be rotated in the tub 110. Laundry is put in the drum 106. At the inside of the drum 106 are mounted lifters 130, which serve to lift and then drop some of the laundry or the wash water during the rotation of the drum 106.

Also, a plurality of through-holes 126 are formed in the side wall of the drum 106. The drum 106 and the tub 110 communicate with each other through the through-holes 126, and therefore, the wash water is introduced into and discharged out of the drum 106. In addition, steam, which will be described below, is introduced into or discharged out of the drum 106.

A driving force necessary to rotate the drum 106 is generated by the motor 104. The driving force is transmitted to the drum 106 through the washing shaft 150.

At the front part of the cabinet 101 is mounted a door 102, by which the interior and the exterior of the drum selectively communicate with each other. Specifically, the user can put laundry into the drum 106 or remove the laundry from the drum 106 by opening and closing the door 102.

The door 102 is provided at the drum-side part thereof with a protrusion part 103, by which the laundry is washed only within the drum. Specifically, the protrusion part 103 serves to prevent the laundry from being pushed toward the door 102 and escaping from the interior of the drum 106.

Between the door 102 and the tub 110 is mounted a gasket 140, which serves to prevent the leakage of the wash water.

Meanwhile, the drum-type washing machine according to the present invention may further include a steam supply unit for supplying high-temperature steam or high-temperature and high-pressure steam into the tub 110 and the drum 106. The steam supply unit includes a steam generator 120 for generating steam and a steam supplier 122 for supplying the generated steam into the tub 110 and the drum 106.

When the steam is supplied into the tub 110 and the drum 106 through the steam supply unit, the inner temperature and the inner humidity of the tub 110 and the drum 106 are increased.

In addition, the drum-type washing machine according to the present invention may further include an input unit 161 for allowing a user to input a command for cleaning the inner circumferential surface of the tub 110. In a general drum-type washing machine, a rotary knob or a plurality of buttons are mounted at the control panel such that the user can input a command for the operation of the drum-type washing machine. Consequently, the input unit 161 may be mounted at the rotary knob for allowing the user to input a command for cleaning the tub 110. Alternatively, the input unit 161 may be mounted at the control panel as an additional button.

Of course, the tub cleaning may be performed when a conventional operation mode is inputted.

In the drum-type washing machine according to the present invention, on the other hand, it is preferable that, when the user inputs a command for cleaning the tub 110 through the input unit 161, buttons which are not being used cannot be activated. For example, it is preferable that the water level, the water temperature, and the rotation speed of the drum be compulsorily set to predetermined levels.

This is because the tub cleaning operation of the drum-type washing machine according to the present invention is effectively performed only within a specific range of water level or a specific range of rotation speed of the drum, and therefore, the user must be prevented from unintentionally inputting the water level, the water temperature, and the rotation speed of the drum.

As described above, the drum-type washing machine according to the present invention includes the control unit 160, which controls the operation of the drum-type washing machine. Specifically, the control unit 160 controls the driving of the motor 104 for driving the drum 106, particularly, the rotation speed of the motor 104, and the water level of wash water stored in the tub 110. For example, the control unit 160 controls the drum 106 to be rotated at a predetermined rotation speed based on a washing, rinsing, or spin-drying operation depending upon the inputted operating conditions.

In the drum-type washing machine according to the present invention, however, the control unit 160 may control the rotation speed of the drum 106 to be within a rotation speed section different from the above-described rotation speed of the drum 106. And the wash water must reach the upper side part of the inner circumferential surface of the tub 110 within the rotation speed section. Specifically, the control unit 160 controls the drum 106 to be rotated at a speed higher than the predetermined rotation speeds of the drum 106 for the washing or rinsing operation such that the wash water can reach the upper side part of the inner circumferential surface of the tub 110 due to a centrifugal force and a frictional force. In addition, it is preferable that the wash water having reached the upper side part of the inner circumferential surface of the tub 110 circulate continuously along the inner circumferential surface of the tub 110.

Hereinafter, the flow of the wash water at the time of cleaning the gasket 140 or the tub 110 will be described in more detail with reference to FIG. 3.

Arrows 600 of FIG. 3 indicate the flow of the wash water circulating along the inner circumferential surface of the tub 110. As the drum 106 is rotated at the predetermined rotation speed, the wash water circulates continuously along the inner circumferential surface of the tub 110. Specifically, the water current generated due to the circulation of the wash water flows along the inner circumferential surface of the tub 110 so as to clean the tub 110.

On the other hand, arrows 700 of FIG. 3 indicate the flow of the wash water which has been raised and then dropped without circulating along the inner circumferential surface of the tub 110. This wash water drops the gasket 140 mounted between the door 102 and the tub 110, particularly, the lower part of the gasket 140, to form a strong water current.

Meanwhile, the protrusion part 103, which is formed at the drum-side part of the door 102, is omitted from FIG. 3. The direction of the wash water introduced to the gasket is smoothly formed due to the shape of the protraction part 103. Specifically, the wash water does not directly drop to the specific part of the gasket 140 where the pollutants are accumulated, but flows to the lower part of the gasket 140 where the pollutants are accumulated along a flow channel formed in the shape of an arc along a part of the gasket 140 at one side of the gasket 140, thereby cleaning the pollutants.

In addition, the control unit controls the water level of the wash water stored in the tub 110 to be equal to or higher than a predetermined water level for the washing or rinsing operation and lower than the full water level.

This is because the wash water does not circulate at the too low water level even though the rotation speed of the drum 106 is increased, whereas the load applied to the motor 104 is increased and the possibility of water leakage is increased at the too high water level.

Of course, it is preferable for the control unit 160 to control the rotation speed of the drum 106 such that the wash water reaches the upper side part of the inner circumferential surface of the tub 110 and then circulates along the inner circumferential surface of the tub 110.

Specifically, when the wash water circulates continuously along the inner circumferential surface of the tub 110, the pollutants or the scale accumulated at the inner circumferential surface of the tub 110 can be cleaned by the strong water current.

On the other hand, it is preferable for the control unit 160 to control the rotation speed of the drum 106 such that the rotation speed of the drum 106 at the time of the tub cleaning is less than the rotation speed of the drum 106 at the time of the spin-drying so as to prevent overload.

Here, it is preferable to optimize the rotation speed of the drum 106 for the tub cleaning. Specifically, it is preferable to optimize the rotation speed of the drum 106 such that the tub 110 can be the most effectively cleaned. Of course, this optimization may be greatly connected with the water level of the wash water supplied into the tub 110. In consideration of noise and load applied to the motor 104, the rotation speed of the drum 106 at the time of the tub cleaning must be less than the rotation speed of the drum 106 at the time of the spin-drying.

As a result of experiments to find the optimum conditions between the rotation speed of the drum 106 at the time of the washing or the rinsing and the rotation speed of the drum 106 at the time of the spin-drying, the inventor of the present invention has found that the tub 110 can be effectively cleaned at a rotation speed of the drum 106 approximately 4 or 5 times higher than the rotation speed of the drum 106 at the time of the washing or the rinsing.

In other words, when the rotation speed of the drum 106 at the time of the washing or the rinsing is 40 to 50 RPM, the optimum rotation speed of the drum 106 for the tub cleaning is approximately 160 to 250 RPM, at which the optimum tub cleaning effect is expected.

Hereinafter, the control of the water level for the tub cleaning of the drum-type washing machine according to the present invention will be described with reference to FIG. 4, which is an enlarged view illustrating the lower parts of the tub and the drum of the drum-type washing machine shown in FIG. 2.

Referring to FIG. 2, the uppermost dotted line indicates a full water level 500. Here, the full water level is a water level at which the tub and the drum are filled with wash water, and therefore, the wash water may overflow into the gasket 140. The remaining dotted lines indicate a gasket cleaning water level 400, a rinsing water level 300, and a washing water level 200, respectively. These water levels are not absolute water levels but relative water levels.

In addition, these relative water levels may be equally applied even in the case of a tilting drum-type washing machine in which the rotation axis shown in FIG. 4 is not parallel with the ground but is inclined at a predetermined angle to the ground. In this case, of course, the front part of the drum is higher than the rear part of the drum, and therefore, the water level at the front part of the drum is different from the water level at the rear part of the drum.

Preferably, the control unit 160 controls the water level of the wash water such that the water level of the wash water is higher than the minimum water level at which some of the wash water also circulates in the drum and lower than the full water level. This control operation is performed in consideration of the circulation of the wash water along the inner circumferential surface of the tub and the load applied to the motor.

First, the minimum water level of the wash water supplied into the tub for the tub cleaning or the effective laundry washing must be equal to or greater than the washing water level 200 at least. This is because, when even a portion of the lower part of the drum is not submerged in the wash water as shown in the drawing, only the drum is rotated irrespective of the rotation speed of the drum.

Consequently, the control unit 160 must control the water level of the wash water supplied into the tub such that the wash water can circulate along the inner circumferential surface of the tub.

At the full water level, the wash water may be pushed toward the door, and therefore, the possibility of the water leakage is increased. In addition, the frictional force between the drum and the wash water is increased, and therefore, the possibility of the noise and vibration generation is increased. Furthermore, overload may be applied to the motor. Consequently, it is preferable that the water level of the wash water for the tub cleaning be lower than the full water level.

Meanwhile, the rinsing water level 300 is generally higher than the washing water level 200. This is because the laundry must be rinsed so as to remove the detergent or the pollutants from the laundry.

In the case that the wash water circulates along the inner circumferential surface of the tub at the rinsing water level 300, it is possible to accomplish the effective tub cleaning as described above. In this case, however, the circulation of the wash water in the drum comes into question. This is because, when there is no wash water in the drum at the time of tub cleaning, i.e., there is no wash water in the drum when a user looks into the drum through the door, the user cannot visually confirm whether the tub cleaning is being performed.

Consequently, it is preferable to control the water level of the wash water such that some of the wash water circulates in the drum.

Also, it is preferable for the control unit to control the water level of the wash water such that the gasket 140 can be cleaned by the wash water circulating in the drum or the wash water which has been raised by the rotation of the drum but dropped to the side of the tub without circulating along the inner circumferential surface of the tub.

As shown in FIG. 4, the gasket 140 includes a door-side gasket part 141 and a tub-side gasket part 142. The tub-side gasket part 142 is concaved, and therefore, the remains of the detergent, the pollutants, or the scale may be easily accumulated in the tub-side gasket part 142. However, the tub-side gasket part 142 cannot be easily seen by the user. As a result, the pollutants remain not removed, and therefore, the pollutants give off a bad smell or the laundry may be polluted by the pollutants.

Consequently, it is necessary to remove the pollutants from the gasket. According to the present invention, it is possible to clean the gasket as well as the tub without the provision of an additional cleaning device.

In order to clean the gasket, the water level of the wash water must be controlled to be higher than the rinsing water level such that some of the wash water circulating in the drum at the time of the tub cleaning is supplied to the gasket. On the other hand, the water level of the wash water must be controlled to be lower than the water level at which the gasket is submerged in the wash water at the time of the tub cleaning.

Consequently, the lower part of the gasket is cleaned due to a strong water current generated by the circulation of the wash water.

Hereinafter, a tub cleaning method of the drum-type washing machine according to the present invention will be described.

First, wash water for the tub cleaning is introduced into the tub and stored in the tub. Subsequently, during the introduction of the wash water or after the storage of the wash water in the tub, the drum is rotated to clean the tub.

In the tub cleaning step, the wash water circulates along the inner circumferential surface of the tub to clean the inner circumferential surface of the tub. Specifically, a strong water current is formed to clean the inner circumferential surface of the tub. At this time, the rotation speed of the drum and the water level of the wash water must be such that the wash water can circulate along the inner circumferential surface of the tub.

On the other hand, the water storage step may be performed after a user inputs a command for cleaning the inner circumferential surface of the tub. Specifically, the tub cleaning may be performed separately from other operations with the provision of an additional input unit for allowing the user to input a command for the tub cleaning.

The tub cleaning method of the drum-type washing machine according to the present invention may further include a soaking step of applying moisture and heat to the pollutants or the scale such that the pollutants or the scale is activated, and therefore, is easily removed from the tub.

Specifically, the soaking step may be accomplished by supplying steam into the tub or the drum for a predetermined period of time.

More specifically, in the soaking step, high-temperature and high-pressure steam may be supplied into the tub or the drum such that the inner temperature and the inner humidity of the tub and the drum are increased, and therefore, the pollutants are soaked, before, after, or simultaneously with the water storage step.

In the soaking step and the cleaning step, the wash water circulates along the inner circumferential surface of the tub by the rotation of the drum. The drum may be controlled to be repeatedly rotated in the forward direction, stopped, and then rotated in the reverse direction.

Specifically, the circulating direction of the wash water is changed to improve the soaking and cleaning effects. Of course, the gasket cleaning effect is also improved.

Also, the drum may be controlled to be rotated only in one direction for a predetermined period of time at the beginning of the soaking step and the cleaning step such that the wash water sufficiently circulates along the entire inner circumferential surface of the tub.

Preferably, the rotation speed of the drum is controlled such that the rotation speed of the drum at the cleaning step is greater that the rotation speed of the drum at the soaking step. This is because the cleaning step removes the pollutants using a water current, and therefore, the cleaning step requires a stronger water current. Preferably, the rotation time of the drum in one direction is controlled to be longer at the cleaning step than the soaking step.

In the soaking step, on the other hand, it is preferable for a sufficient amount of wash water to circulate along the entire inner circumferential surface of the tub for a sufficient period of time. Consequently, it is preferable to control the water level of the wash water such that the water level of the wash water at the soaking step is higher than the water level of the wash water at the cleaning step.

Also, the tub cleaning method of the drum-type washing machine according to the present invention may further include a rinsing step of completely discharging the pollutants removed from the tub at the cleaning step out of the washing machine.

The rinsing step may be accomplished by repeatedly draining the wash water and cleaning the inner circumferential surface of the tub such that the pollutants removed from the tub after the cleaning step cannot remain in the tub or the drum.

Here, it is preferable that the water level of the wash water at the rinsing step be controlled to be higher than the water level of the wash water at the cleaning step and lower than the water level of the wash water at the soaking step.

The water drainage at the rinsing step may be accomplished by performing a spin-drying step of rotating the drum at the spin-drying speed for a predetermined period of time so as to completely discharge the water and the pollutants from the drum and the tub.

Finally, it is preferable that the water temperature at the cleaning step be controlled to be equal to or higher than a predetermined temperature level so as to activate the pollutants. The water temperature may be controlled to be approximately 70?. Specifically, the water temperature may be controlled by turning a heater on and off.

The present invention has been described with reference to the drum-type washing machine in which the rotation axis of the drum is substantially parallel with the ground. However, the present invention is not limited to the illustrated embodiment.

For example, the present invention may be equally applied to a tilting drum-type washing machine in which the rotation axis of the drum is inclined at a predetermined angle to the ground.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The present invention provides the following effects.

First, the present invention provides the effect of cleaning the pollutants or the scale accumulated at the entire inner circumferential surface of the tub.

Second, the present invention provides the effect of easily cleaning the tub without the provision of an additional tub cleaning device.

Third, the present invention provides the effect of eliminating the necessity of using a special detergent for the tub cleaning, and effectively accomplishing the tub cleaning using a small amount of the detergent even when the use of the special detergent for the tub cleaning is needed, thereby accomplishing the environmentally friendly tub cleaning.

Fourth, the present invention provides the effect of easily cleaning the gasket simultaneously with the tub cleaning.

The invention claimed is:

1. A drum-type washing machine, comprising:

a tub mounted in a cabinet such that wash water is supplied into the tub;

a drum rotatably mounted in the tub such that laundry is put into the drum;

a motor that rotates the drum; and a controller that controls a driving of the motor such that, when the drum is rotated, the wash water supplied into the tub reaches an upper part of an inner circumferential surface of the tub so as to clean the inner circumferential surface of the tub, wherein the controller controls a rotation speed of the drum such that the wash water supplied into the tub circulates along the inner circumferential surface of the tub, and wherein the controller controls the rotation speed of the drum to be higher than a predetermined rotation speed of the drum for a washing or rinsing operation and lower than a predetermined rotation speed of the drum for a spin-drying operation.

2. The washing machine according to claim 1, wherein the controller controls the drum to be rotated at a rotation speed approximately 4 to 5 times higher than the predetermined rotation speed of the drum for the washing operation.

3. The washing machine according to claim 1, wherein the controller controls a water level of the wash water such that, when the drum is rotated, the wash water supplied into the tub reaches the upper part of the inner circumferential surface of the tub so as to clean the inner circumferential surface of the tub.

4. The washing machine according to claim 3, wherein the controller controls the water level of the wash water such that the wash water supplied into the tub circulates along the inner circumferential surface of the tub.

5. The washing machine according to claim 4, wherein the controller controls the water level of the wash water to be equal to or higher than a predetermined water level for a washing or rinsing operation and lower than a full water level.

6. The washing machine according to claim 5, wherein the controller controls the rotation speed of the drum such that the lower the water level of the wash water supplied into the tub, the higher the rotation speed of the drum.

7. The washing machine according to claim 1, wherein the controller controls a water level of the wash water and the rotation speed of the drum such that, when the drum is rotated, some of the wash water supplied into the tub drops so as to clean a gasket.

8. The washing machine according to claim 1, further comprising:

an input device that allows a user to input a command for cleaning the inner circumference surface of the tub.

9. The washing machine according to claim 1, further comprising:

a steam supply device that supplies a high-temperature steam or high-temperature and high-pressure steam into the tub or the drum.

10. A tub cleaning method for a drum-type washing machine, comprising:

introducing wash water into a tub and storing the wash water in the tub; and cleaning an inner circumferential surface of the tub using the wash water which circulates along the inner circumferential surface of the tub as a drum is rotated at a predetermined rotation speed by a driving of a motor, which is controlled by a controller, wherein the controller controls the rotation speed of the drum to be higher than a predetermined rotation speed of the drum for a washing or rinsing operation and lower than a predetermined rotation speed of the drum for a spin-drying operation.

11. The tub cleaning method according to claim 10, further comprising:

supplying steam into the tub or the drum such that an inner temperature and humidity of the tub and the drum are increased, and pollutants accumulated at the inner circumferential surface of the tub are soaked, before, after, or simultaneously with the storing of the wash water in the tub.

12. The tub cleaning method according to claim 10, further comprising:

repeatedly draining the wash water and cleaning the inner circumferential surface of the tub such that pollutants removed from the tub are removed from the tub or the drum after the cleaning of the inner circumferential surface of the tub.

13. The tub cleaning method according to claim 12, wherein a water level of the wash water during the repeatedly draining of the wash water and cleaning of the inner circumferential surface of the tub is controlled to be higher than a water level of the wash water during the cleaning of the inner circumferential surface of the tub.

14. The tub cleaning method according to claim 10, wherein a water temperature of the wash water during the cleaning of the inner circumferential surface of the tub is controlled by turning a heater on and off such that the water temperature of the wash water is equal to or higher than a predetermined temperature so as to activate pollutants.

15. The tub cleaning method according to claim 10, wherein, during the cleaning of the inner circumferential surface of the tub, the drum is repeatedly rotated in a forward direction and in a reverse direction.

16. A gasket cleaning method for a drum-type washing machine, comprising:

introducing a wash water into a tub and storing the wash water in the tub; and cleaning a gasket using the wash water which reaches an upper part of an inner circumferential surface of the tub and then drops as a drum is rotated at a predetermined rotation speed by a driving of a motor, which is controlled by a controller, wherein the controller controls the rotation speed of the drum to be higher than a predetermined rotation speed of the drum for a washing or rinsing operation and lower than a predetermined rotation speed of the drum for a spin-drying operation.

17. The gasket cleaning method according to claim 16, wherein, during the cleaning of the gasket, some of the wash water circulates along the inner circumferential surface of the tub so as to clean the inner circumferential surface of the tub.

18. The gasket cleaning method according to claim 16, wherein the controller controls a water level of the introduced wash water to be higher than a water level for the rinsing operation and lower than a water level at which the gasket is submerged in the wash water.

* * * * *